US006543063B2

(12) United States Patent
Greer

(10) Patent No.: US 6,543,063 B2
(45) Date of Patent: Apr. 8, 2003

(54) GOLF SOCK WITH TEE HOLDER

(76) Inventor: Kamla Greer, 1255 Jacob La, Carmichael, CA (US) 95608

( * ) Notice: Subject to any disclaimer, the term of this patent is extended or adjusted under 35 U.S.C. 154(b) by 0 days.

(21) Appl. No.: 09/997,668

(22) Filed: Nov. 29, 2001

(65) Prior Publication Data

US 2002/0062516 A1 May 30, 2002

Related U.S. Application Data

(60) Provisional application No. 60/250,791, filed on Nov. 30, 2000.

(51) Int. Cl.[7] ..... A43B 17/00
(52) U.S. Cl. ..... 2/239; 2/409
(58) Field of Search ..... 2/239, 409, 69, 2/1; 224/918; 434/395, 397–400, 392, 252; 36/113, 114, 127, 136

(56) References Cited

U.S. PATENT DOCUMENTS 2,691,779 A * 10/1954 Bell ..... 2/239
3,674,189 A * 7/1972 Walbeck ..... 224/918
4,129,237 A * 12/1978 Grinder ..... 224/918
4,498,615 A * 2/1985 Johnson ..... 224/918
4,630,383 A * 12/1986 Gamm ..... 36/114
4,886,196 A * 12/1989 Plummer ..... 224/918
5,365,609 A * 11/1994 Herzog ..... 2/161.4
5,433,436 A * 7/1995 Hoyt et al. ..... 224/918
6,102,201 A * 8/2000 Marston et al. ..... 224/918
6,173,451 B1 * 1/2001 De Vincenzi ..... 2/162
6,205,588 B1 * 3/2001 Shin ..... 2/161.4

* cited by examiner

*Primary Examiner*—Gloria M. Hale
(74) *Attorney, Agent, or Firm*—John P. Costello; Weintraub Genshlea Chediak Sproul

(57) ABSTRACT

A golf sock with a golf tee holder coupled thereto. The golf tee holder is coupled to the body portion of the sock and includes one or more receptacles for holding golf tees vertically upon the body portion. The golf tee holder is comprised of an elastic material that stretches to hold the golf tees snugly within each receptacle. The golf tee holder is positioned on the body portion of the sock a sufficient distance above the foot portion of the sock so as not to interfere with the wearing of shoes during normal golf play.

1 Claim, 1 Drawing Sheet

GOLF SOCK WITH TEE HOLDER

CROSS REFERENCE TO RELATED APPLICATIONS

This application claims the benefit of U.S. provisional patent application No. 60/250,791, filed on Nov. 30, 2000.

FIELD OF THE INVENTION

This invention pertains generally to golf accessories and more specifically relates to golf tee holders.

BACKGROUND

Golf tees are necessary to the game of golf. A person playing a game of golf must have enough tees at the ready to complete a fully nine-hole or eighteen-hole game. Due to breakage or loss of tees when the golf ball is struck at tee-off, the player must have a plurality of tees that are accessible. If the tees are not accessible, a golf game must be delayed while a player searches his golf bag or some other location for more tees. Such a delay of game is typically bad etiquette in golf, as it causes golfing partners as well as advancing groups of golfers to delay their games while tees are located.

A number of golfing accessories have been devised to make sure that golf tees are readily accessible. Some of these accessories involve golf tee holders that are attached to wrist bands, golf gloves, belt clips, and the like. U.S. Pat. No. 2,321,360 describes a golf tee carrier that is clipped to the side of a shoe and held on with an elastic strap. A drawback to many of these golf tee holders is that they often involve coupling a golf tee holder with an odd accessory such as a wrist band, belt clip, or the strap-on carrier shown in the '360 patent. Most golfers do not normally wear such odd accessories, and when they get dressed to play a golf game, often forget to put them on. While golf gloves are not an odd clothing item for golf, placing a golf tee holder on a golf glove loaded with golf tees can often interfere with a proper golf grip.

Therefore, a need exists for a common golf article of clothing having a golf tee holder thereon, wherein the holder is placed such that it does not interfere in any way with a player's performance during the game of golf.

The foregoing discussion reflects the state of the art which the inventor is aware, and is tendered with a view toward discharging the inventor's acknowledged duty of candor in disclosing information which may be pertinent with regards to the patentability of the present invention. It is respectfully stipulated, however, that the disclosed information does not teach or render obvious, singly or when considered in combination, the inventor's claimed invention.

SUMMARY OF THE INVENTION

This invention relates to a golf sock having a tee holder. In the preferred embodiment the tee holder is a flexible, elastic material sewn to the body portion of the sock so that a one or a plurality of golf tee receptacles are formed. The receptacles are elongate pockets and are positioned in a vertical manner on the body portion of sock so that the tees are likewise held vertically.

As such the following objects and advantages are sought to be achieved by the inventive golf sock:

An object of this invention is to provide a common golf clothing article having a tee holder, such as a sock, so that the player, upon putting on his golf socks will have a tee holder already in place, thereby obviating the necessity for the player to search for an odd accessory such as a wrist band holder or belt clip holder in order to hold golf tees.

Another object of this invention is to provide a golf tee holder on a sock, that is relatively unnoticeable and that does not restrict a player's movement while playing the game of golf.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
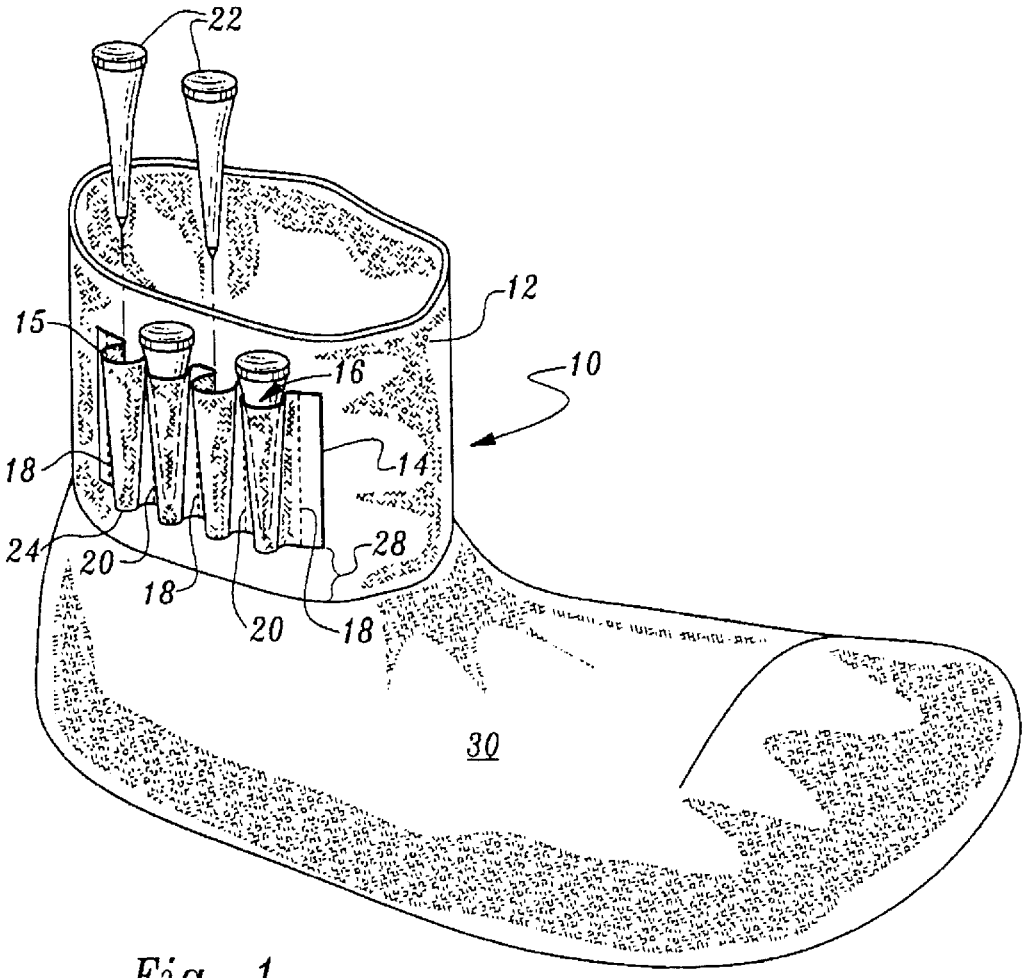
FIG. 1 is a perspective view of the inventive golf sock shown with golf tees being positioned in the receptacles of the golf tee holder.
Figure 2:
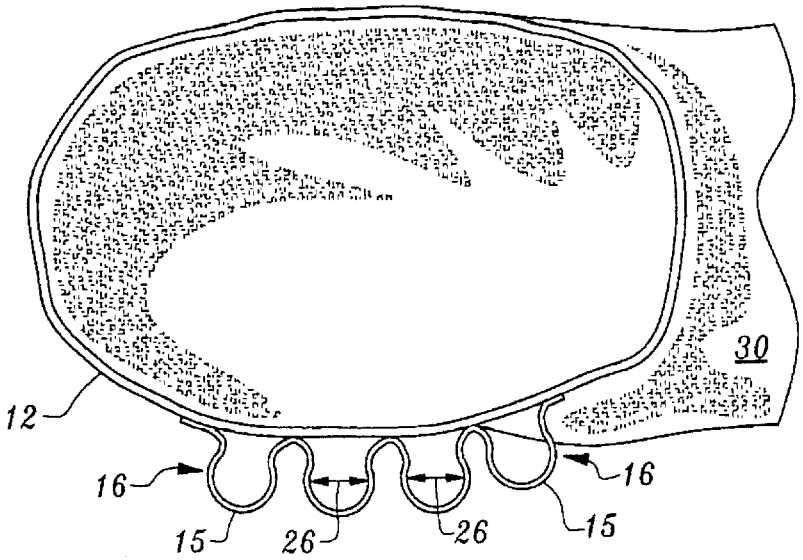
FIG. 2 is a plan view of the inventive golf sock showing the golf tee holder coupled to the inside of the body portion of the golf sock, the top openings of the receptacles being shown.

Referring more specifically to the drawings, for illustrative purposes, the present preferred embodiment of the inventive golf sock 10 is shown in FIG. 1. The inventive golf sock shown has a low-rise body portion 12, of a type common for golf socks, but body portion 12 can be of a mid-rise or high-rise type as well. Tee holder 14 is generally rectangular and coupled to sock 10 with stitching, glue or other means well known in the art. Tee holder 14 is comprised of an elastic material made from a cotton or polyester blend that is then sewn to the body portion 12 of sock 10. The elastic material is gathered to form the walls 15 of one or more receptacles 16 and is then stitched at locations 18, 20 to fasten the tee holder 14 to sock 10. The receptacle 16 formed is that of a vertical tube or pocket, having a length sufficient to hold a tee therein so as to avoid having the sharp end of the tee 22 protrude from the bottom 24 of receptacle 16 in an interfering manner. Receptacle 16 has an open cross section 26 inside of walls 15 for placing golf tees, which can be shaped, depending on how the receptacle walls are stitched. FIG. 2, shows the tee holder 14 having a plurality of receptacles 16 with circular walls 15 and semi-circular cross sections 26. The cross section 26 of receptacle 16 is sized to fit any standard golf tee 22 inserted therein in a snug manner. Due to the elastic material comprising golf tee holder 14, the cross section 26 of receptacle 16 can be smaller than the cross section of the majority of a golf tee, the material still being able to expand and snugly fit a golf tee inserted therein. Once inserted, a golf tee 22 is snugly held by the walls 15 of the receptacle 16 in a relatively immovable manner. This snug fit keeps golf tees placed in the receptacle from moving around, or bouncing out of receptacle during a normal round of golf.

Golf tee holder 14 is preferably positioned on body portion 12 of sock 10 a distance 28 above the foot portion 30 of sock 10 so as not to interfere with the wearing of golf shoes during a round of play. Golf tee holder 14 can be placed upon the inside or outside of body portion 12. Also, a pair of socks can have the holder 14 placed on one or both socks. Further, golf tee holder 14 can be of a different color than the sock or else contain a logo, if desired.

Accordingly, the inventive golf tee sock described herein offers a golfer a convenient and readily accessible holder for carrying golf tees during a round of play.

Finally, although the description above contains many specificities, these should not be construed as limiting the scope of the invention but as merely providing illustrations of some of the presently preferred embodiments of this invention. This invention may be altered and rearranged in numerous ways by one skilled in the art without departing from the coverage of the appended claims.

I claim:

1. A pair of golf socks, comprising:

first and second socks having afoot portion and a body portion, wherein at least one of said socks has a golf tee holder coupled to said body portion, said golf tee holder including a plurality of receptacles for holding golf tees, said golf tee holder being elastic for snugly fitting golf tees in said receptacles wherein said receptacles are of a length for covering the sharp end of a golf tee when said tee is placed in said receptacle.

* * * * *